US006691827B2

(12) United States Patent
Lycett

(10) Patent No.: US 6,691,827 B2
(45) Date of Patent: Feb. 17, 2004

(54) ADJUSTABLE ANCHORAGE

(75) Inventor: Peter Lycett, Sutton Coldfield (GB)

(73) Assignee: Multi-Stroke Limited (GB)

( * ) Notice: Subject to any disclaimer, the term of this patent is extended or adjusted under 35 U.S.C. 154(b) by 92 days.

(21) Appl. No.: 09/778,582

(22) Filed: Feb. 7, 2001

(65) Prior Publication Data

US 2001/0011694 A1 Aug. 9, 2001

(30) Foreign Application Priority Data

Feb. 9, 2000 (GB) ..... 0002881

(51) Int. Cl.[7] ..... A62B 37/00
(52) U.S. Cl. ..... 182/138; 248/228.5
(58) Field of Search ..... 248/228.1, 228.2, 248/228.3, 228.4, 228.5; 182/138, 3, 36

(56) References Cited

U.S. PATENT DOCUMENTS 947,441 A * 1/1910 Hankin ..... 248/72
2,442,266 A * 5/1948 Davis ..... 24/134 R
3,217,833 A 11/1965 Delmer
3,527,319 A 9/1970 Pedley
4,451,956 A * 6/1984 Kawahara ..... 24/302
5,307,897 A 5/1994 Turner et al.
5,429,206 A 7/1995 Nusbaum
5,529,144 A * 6/1996 Henderson ..... 182/3

FOREIGN PATENT DOCUMENTS

FR 1328997 12/1963

* cited by examiner

*Primary Examiner*—Alvin Chin-Shue
(74) *Attorney, Agent, or Firm*—Nixon Peabody LLP

(57) ABSTRACT

An anchorage for anchoring an article to a bilateral flange which can have a width in a wide range of widths. First and second hooks are hooked over opposite flanges and securely retained thereon by a webbing strap of adjustable length extending between the two hooks. The webbing strap is permanently secured at one end to one of the hooks, and extends through a clamp on the other hook. The length of the webbing strap between the two hooks is fully adjustable in a wide range to accommodate the varying flange widths. As an alternative to a webbing strap and clamp, the hooks can be adjustably linked by an interpenetrating tongue and slot or buckle, mutually latched at a selected hook separation by a detent having projections urged into notches on the tongue. The anchorage is particularly suitable for securing a safety net to the lower flange of an I-beam in a steel-framed building under construction, since the anchorage is quick and easy both to install and to dismount while easily accommodating a wide range of beam sizes, and always leaves the top edges of beams free to allow them to support flooring without dismounting the anchorage.

16 Claims, 3 Drawing Sheets

300
302
304
306
308
310
312
314
316
326
328
330
332
334
336
340
342
344
346
348
350
10
12
14
16
FLANGES 1/4" BETWEEN SIDES: 3/8 WIDE
BAND 14-40 THICK.

ADJUSTABLE ANCHORAGE

FIELD OF THE INVENTION

This invention relates to an adjustable anchorage, and relates more particularly but not exclusively to an anchorage for a safety net to be utilised during the construction of a building, the net requiring to be reliably anchored to the lower flanges of I-beams forming the skeleton of the building being constructed.

BACKGROUND OF THE INVENTION

It is currently common for buildings, particularly larger commercial premises, to be constructed around a three-dimensional skeleton or framework of steel I-beams which serve to support concrete flooring slabs or metal deck flooring. Most of the framework is usually at a considerable height above ground, and consequently falls present a grave risk of death or injury to construction workers. The injury risk from falls is mitigated by the use of a safety net suspended from the I-beams around the edge of a floor level or other work location in the building. In the United Kingdom, parts 1 and 2 of BS EN 1263 govern such safety nets and their deployment. Part 2 of BS EN 1263 directs that safety nets be attached to horizontal beams by passing a securing rope alternately through the edge of the net and around the beam. While such an attachment procedure can securely anchor the net (if diligently carried out), the procedure presents certain problems, including the substantial time required to reeve the rope many times through the net edges and around the beams, converse difficulties in removing the rope to free the net (aggravated by weathering of the rope) and the loss of fall protection due to the need to remove the rope (and net) for the laying of flooring supported on the top edges of the beams.

OBJECT OF THE INVENTION

It is an object of the invention to provide an adjustable anchorage which is capable, inter alia, of being applied to reversibly anchoring a safety net to a horizontal I-beam or similar article in a rapid and simple manner without impeding access to the upper surface of the I-beam during such use of the anchorage. (It is to be understood that in this specification and its accompanying claims, use of the term "I-beam" not only encompasses beams whose transverse cross-section resembles an "I" with bilateral flanges on the top and bottom edges of its central web, but also encompasses beams having other cross-sections though always with bilateral flanges (or their mechanical equivalent) along or near the lower edge of such other forms of beam). It is a further object of the invention to provide an adjustable anchorage capable, inter alia, of being adjusted for efficient utilisation on I-beams whose lower edge bilateral flanges have respective widths in a wide range of widths

SUMMARY OF THE INVENTION

According to a first aspect of the invention there is provided an adjustable anchorage comprising first and second hook means each capable of being hooked around a respective opposite edge of a bilateral flange, attachment means on at least one of said first and second hook means for the attachment of an article thereto, and adjustable linking means extending between said first and second hook means for mutually linking said first and second hook means in use of said anchorage with said first and second hook means each hooked around a respective opposite edge of the bilateral flange and for thereupon retaining said first and second hook means against the respective opposite edges of the bilateral flange, with the adjustability of said adjustable linking means allowing effective use of the anchorage on various bilateral flanges having respective widths in a substantial range of widths.

Said adjustable linking means preferably has an adjustable length between said first and second hook means. Said adjustable linking means may comprise a strap or web secured at one end thereof to one of said first and second hook means together with clamp means for clamping the strap or web to the other of said first and second hook means at a selected location along the strap or web displaced from said one end of the strap or web. Said adjustable linking means preferably incorporates tensioning means capable of applying tension between said first and second hook means whereby to force said first and second hook means against the respective opposite edges of the bilateral flange in use of the anchorage, and said tensioning means may comprise an overcentre form of said clamp means tending in use to shorten the strap or web between said one end thereof and said selected location thereon. Said adjustable linking means may alternatively comprise mutually interpenetrating tongue and slot means together with latch means functioning to latch the tongue and slot means together at a mutual interpenetration which places the first and second hook means at a selected mutual separation.

BRIEF DESCRIPTION OF THE DRAWINGS

Embodiments of the invention will now be described by way of example, with reference to the accompanying drawings wherein.

DETAILED DESCRIPTION OF THE PREFERRED EMBODIMENTS

Figure 1:
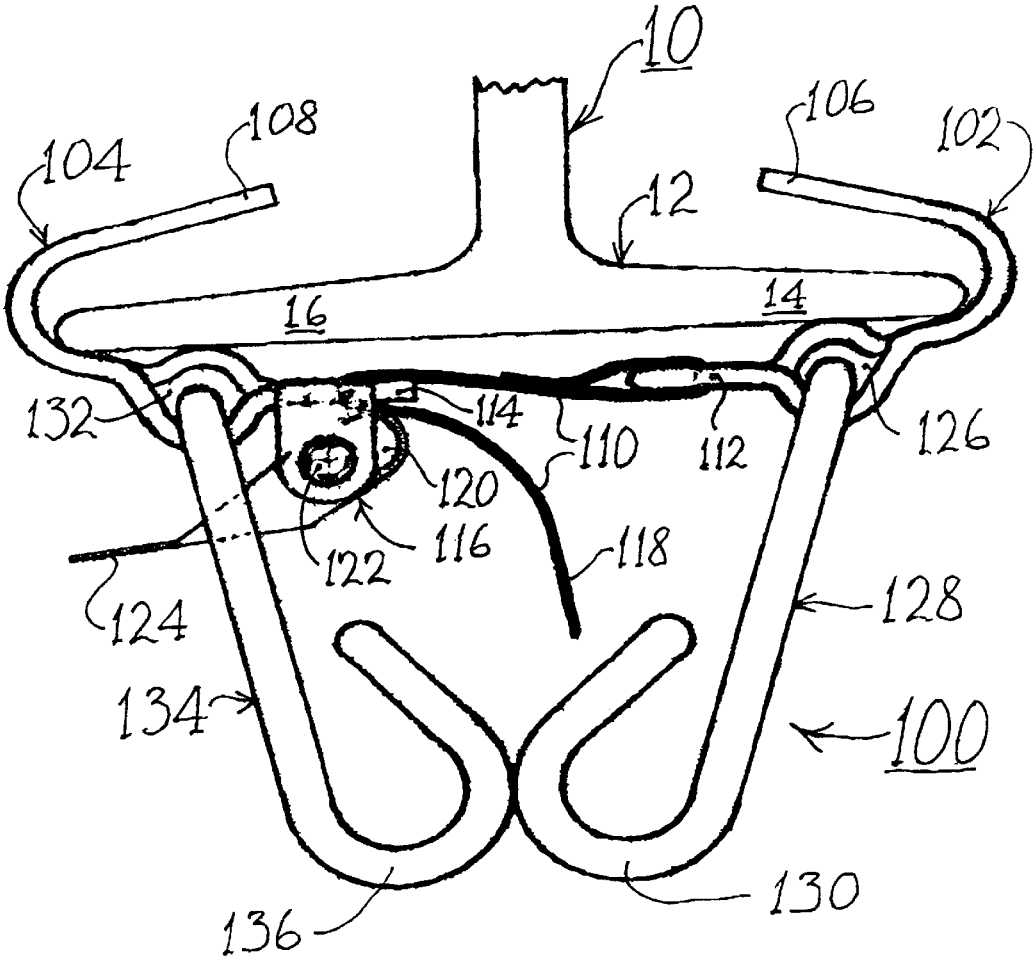
FIG. 1 is an end elevation of a first embodiment.

Referring first to FIG. 1, this is a fragmentary end view of an I-beam 10 (only the lower edge being shown), to which a first embodiment of anchorage 100 is attached. As viewed in FIG. 1, the lower edge of the I-beam 10 is formed with a bilateral flange 12, comprising a right flange 14 and a left flange 16. The I-beam 10 forms part of the framework of a building (not otherwise shown), and is substantially horizontal at a height above ground level which would make a fall from that height liable to cause serious injury. In order to mitigate the risk of falls, the anchorage 100, together with several other substantially identical anchorages (nor separately shown), is utilised to suspend a safety net (not shown), as will subsequently be detailed.

The anchorage 100 comprises a first hook 102 and a second hook 104, each formed from thick steel rod or strip that is suitably protected against corrosion. The free end 106 of the first hook 102 is hooked around the right flange 14 of the I-beam 10, while the free end 108 of the second hook 104 is hooked around the right flange 16. As shown in FIG. 1, the anchorage 100 is only partially installed, and the hooks 102 & 104 are not yet fully tightened against the I-beam flange 12.

A strip 110 of thick fabric webbing is permanently attached to the non-free end 112 of the first hook 102 (i.e. the end of the hook 102 opposite its free end 106). The webbing strip 110 extends from the non-free end 112 of the first hook 102 to the non-free end 114 of the second hook 104 (i.e. the end of the hook 104 opposite its free end 108) where the strip 110 is threaded through a webbing clamp 116 that is secured to the non-free end 114. The free end 118 of the webbing strip 110 (i.e. the end of the strip 110 opposite to its end that is attached to the first hook 102) hangs freely beyond the clamp 116 to be available for tension to be manually applied as part of the procedure for installing the anchorage 100, as will subsequently be detailed.

The webbing clamp 116 comprises a pivoting snail cam 120 which can pivot around a pivot pin 122 mounted in the body of the clamp 116. The snail cam 120 is self-tightening under the tension in the strip 110 which normally occurs between the hooks 102 and 104 in use of the anchorage 100. Such self-tightening of the webbing clamp 116 normally clamps the webbing strip 110 between the cam 120 and the non-free end 114 of the second hook 104 sufficiently tightly as to prevent movement of the strip 110, and hence to prevent mutual separation of the hooks 102 and 104 during use of the anchorage 100. When it is desired to release the clamp 116 (e.g. when the anchorage 100 is to be dismounted from the I-beam 10), a lever 124 attached to the pivoting cam 120 is manually pushed (in an upwards direction as viewed in FIG. 1) so as to turn the cam 120 around its pivot pin 122 sufficiently clockwise (as viewed in FIG. 1) as to release the webbing scrip 110 from the clamp 116, whereupon the hooks 102 and 104 can be manually pulled apart to release them from the flange 12.

The first hook 102 is formed with a central aperture 126 in which a first loosely fitting net-hooking sling 128 is fitted such that its free end 130 hangs below the anchorage 100. Similarly, the second hock 104 is also formed with a central aperture 132 in which a second loosely fitting net-hooking sling 134 is fitted such that its free end 136 hangs below the anchorage 100.

In order to install and use the anchorage 100 (assuming the anchorage 100 initially to be free of the I-beam 100, and the webbing strip 110 to be threaded through the non-free end 114 of the second hook 104 with a sufficient length between the two hooks 102 and 104), the free end 106 of the first hook 102 is hooked around the right flange 14 as shown in FIG. 1, and substantially simultaneously the free end 108 of the second hook 104 is hooked around the left flange 16. This initial installation step is undertaken such that the hooks 102 and 104 are mutually linked beneath the flange 12 by means of the webbing strip 110 extending between the hooks 102 and 104 as shown in FIG. 1. Next, the free end 118 of the webbing strip 110 is grasped and pulled to tighten the initially slack webbing strip between the two hooks 102 and 104, so pulling the hooks 102 and 104 hard against the flanges 14 and 16 respectively. Since the snail cam 120 is self-tightening against movement tending to re-introduce slack into the webbing strip 110 between the hooks 102 and 104, the webbing clamp 116 will automatically clamp the now slack-free webbing strip 110, and the hooks 102 and 104 will remain tightly against the flanges 14 and 16 even when this pull on the strip end 118 ceases. When a sufficient number of other anchorages (identical to the anchorage 100 or of a similar design) are installed at distributed locations along the I-beam 10 and/or along adjacent beams, the edges of a safety net (not shown) are hooked over one or both of the free ends 130 and 136 of the net-hooking slings 128 and 134, and other parts of the safety net edge are similarly hooked onto the other anchorages.

In comparison to the prior art practice of winding a rope repeatedly through the net edges and around the beam, the present invention allows safety net anchorages to be simply and rapidly installed while leaving the upper edges of the beams free to support subsequently laid flooring without requiring the safety net to be removed. Since the length of webbing strip 110 extending between the two hooks 102 and 104 can be easily adjusted in a very wide range of lengths (without the use of tools), the anchorage 100 can be readily adjusted to fit I-beams having widths in a correspondingly wide range of widths, and installed on such different flanges without structural modification.

When the safety net is no longer required, dismounting of the net and its anchorages is similarly simple and rapid.

In suitable circumstances (e.g. if the safety net were provided with its own ties or attachment hooks) the slings 128 and 134 could be omitted, and the safety net directly attached to the hooks 102 and 104, by way of the apertures 126 and/or 132 or in any other suitable manner.

Figure 2:
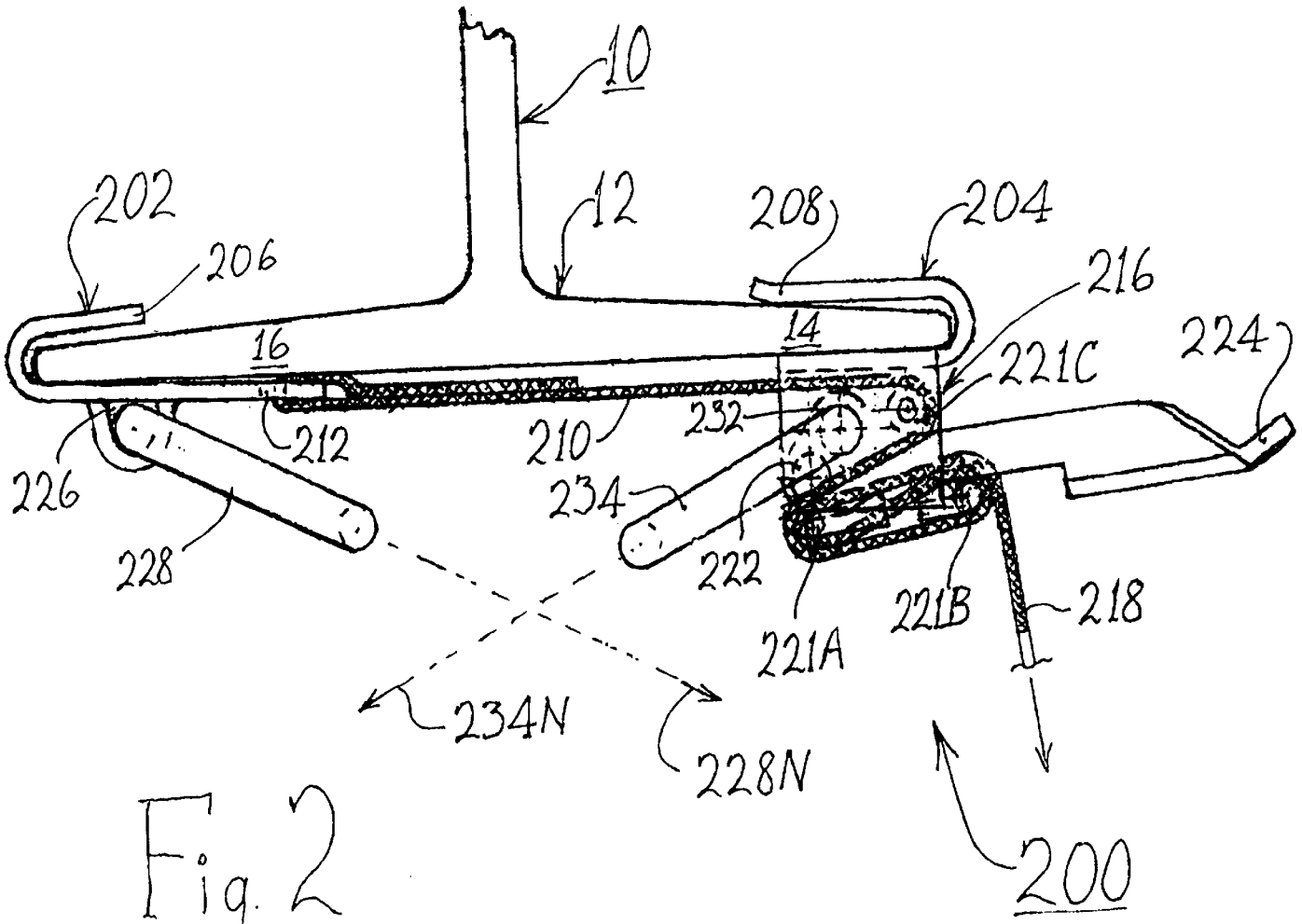
FIG. 2 is an end elevation of a second embodiment.

Turning now to FIG. 2, this is an end view of a second embodiment 200 of anchorage in accordance with the invention. The anchorage 200 is generally similar to the first embodiment 100, but with certain differences in detail. Those parts of the second embodiment 200 that are identical or analogous to equivalent parts in the first embodiment 100 will be given the same reference numerals, but with the leading "1" replaced by a leading "2", and the following description of the second embodiment 200 will concentrate on the detail differences with respect to the first embodiment 100. For a description of any part of the second embodiment 200 not given below, reference should be made to the foregoing description of the identical or analogous part in the first embodiment 100.

Apart from the anchorage 200 being laterally transposed on the I-beam 10 in comparison to the positioning on the I-beam of the anchorage 100, the principal difference in the anchorage 200 with respect to the anchorage 100 lies in the detailed structure and functioning of the clamp 216. As in the clamp 116, the lever 224 is pivotable around its pivot pin 222, but in place of the snail cam 120, the clamp 216 has pins 221A and 221B mounted on the lever 224 parallel to the axis of the pivot pin 222, at different radial distances from the axis of the pivot pin 222. Another pin 221C is fixed on the body of the clamp 216 parallel to the axis of the pivot pin 222, at the body corner opposite to the corner mounting the pivot pin 222. (The purpose of the pins 221A, 221B, & 221C will be explained below).

A further detail difference in the anchorage 200 with respect to the anchorage 100 lies in the replacement of the net-hooking slings 128 and 134 with respective carabiners 228 and 234 (i.e. strong metal closed-loop shackles with selectively fastenable closures as are commonly employed for securing ends of load-carrying ropes and slings).

In order to set up the anchorage 200 for installation, the carabiner 234 is temporarily removed from the body of the clamp 216, the lever 224 is pivoted fully clockwise (as viewed in FIG. 1), the webbing strip 210 is threaded around the pin 221C, and then looped twice around the pins 221A and 221B in the path shown in FIG. 2. Initially, the webbing strip 210 is slack between the hooks 202 and 204. The free end 206 of the first hook 202 is hooked around the I-beam flange 16, and then the free end 208 of the second hook 204 is hooked around the I-beam flange 14. All slack in the webbing strip 210 is taken up, and then the lever 224 is swung fully anti-clockwise to the position shown in FIG. 2. This movement of the lever 224 with the webbing strip 210 entrained around the pins 221A, 221B, and 221C tightens the webbing strip 210 between the two hooks 202 and 204, and forces the hooks 202 and 204 rightly against the flanges 16 and 14 respectively. Finally the carabiner 234 is re-inserted through the aperture 232, and through a matching aperture in the heel of the lever 224; this locks the lever 224 against movement during use of the anchorage 200, and so prevents inadvertent dismounting of the anchorage 200. The safety net (not shown) is attached to the appropriate one of the carabiners 228 and 234 according to the principal direction (228N or 234N) in which the anchorage 200 is stressed in use.

As with the first embodiment 100, since the length of webbing strap 210 extending between the two hooks 202 and 204 in the second embodiment 200 is selectively variable in a very wide range of lengths, the anchorage 200 can be easily adjusted (without the use of tools) to fit I-beams having widths in a correspondingly wide range of widths (such as might be found in the framework of a single building, as well as the width variability that might be expected between different building sites).

When the anchorage 200 is no longer required, it is dismounted from the I-beam 10 by reversing the steps of the above-detailed installation procedure.

In suitable circumstances (e.g. if the safety net were provided with its own ties or attachment hooks) the carabiners 228 and 234 could be omitted, and the safety net directly attached to the hooks 202 and 204, by way of the apertures 226 and/or 232 or in any other suitable manner.

Figures 3, 4:
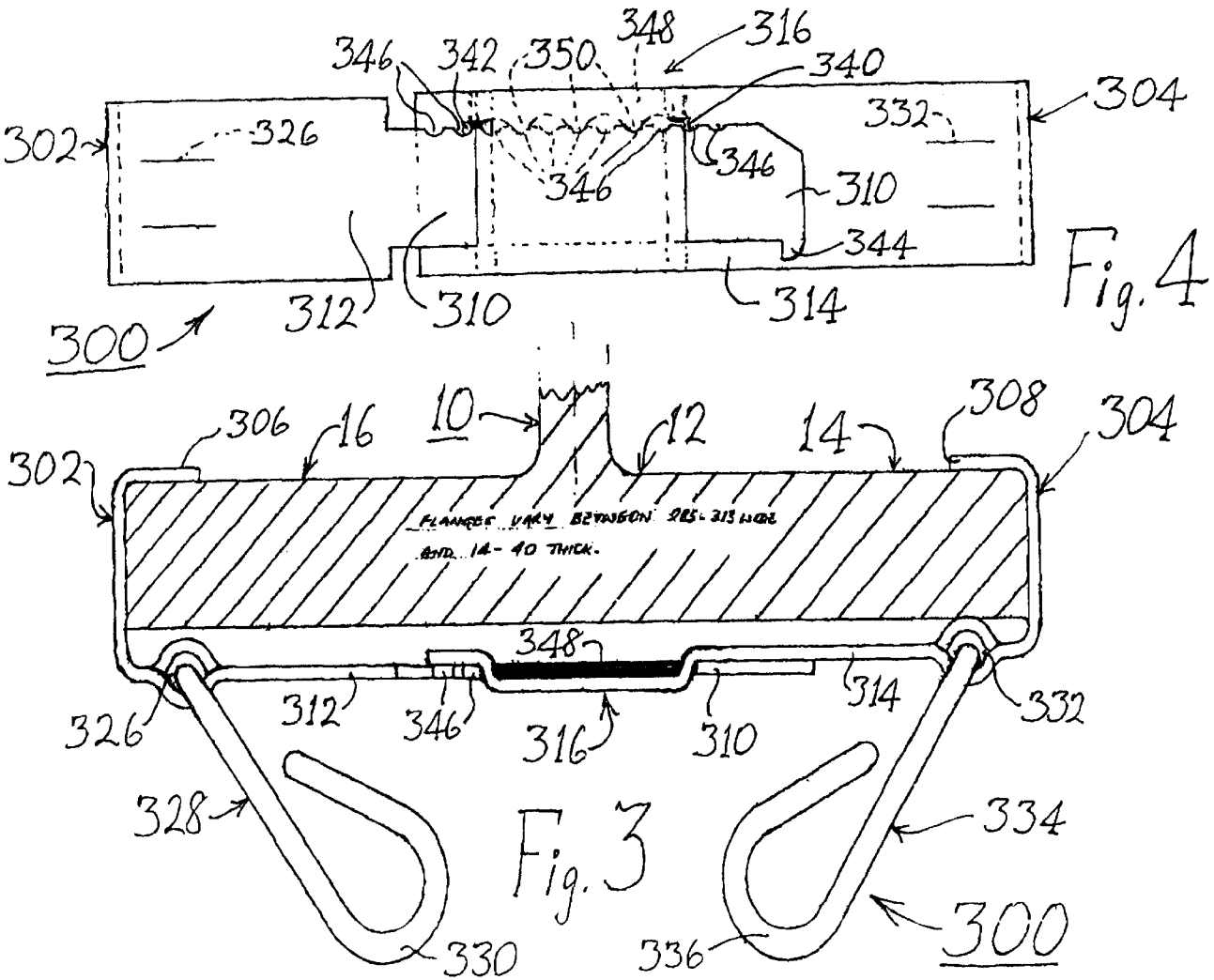
FIG. 3 is an end elevation of a third embodiment.
FIG. 4 is a plan view of the third embodiment from beneath.

Turning now to FIGS. 3 and 4, FIG. 3 is an end view of a third embodiment 300 of anchorage in accordance with the invention, and FIG. 4 is a plan view of the third embodiment 300 from beneath (with the I-beam 10 and slings 328, 334 omitted for clarity). The anchorage 300 is similar in principle to the first and second embodiments 100 and 200, but with certain differences in detail. Those parts of the third embodiment 300 that are identical or analogous to equivalent parts in the first and second embodiments 100 and 200 will be given the same reference numerals, but with the leading "1" or "2" replaced by a leading "3", and the following description of the third embodiment 300 will concentrate on the detail differences with respect to the first and second embodiments 100 and 200. For a description of any part of the third embodiment 300 not given below, reference should be made to the foregoing description of the identical or analogous part in the first and second embodiments 100 and 200.

In FIG. 3 (as in FIG. 2), the anchorage 300 is laterally transposed on the I-beam 10 in comparison to FIG. 1. The anchorage 300 differs from the first and second embodiments 100 and 200 principally in that the straps 110 & 210 and the clamps 116 & 216 of the adjustable linking means (adjustably linking the first and second hooks) are replaced by a tongue 310 on the non-free end 312 of the first hook 302 interpenetrating a buckle-like non-free end 314 of the second hook 304. As shown in both FIGS. 3 & 4, the buckle end 314 is provided with longitudinally spaced transverse slots 340 and 342 between which the buckle end 314 is double-cranked to sandwich the tongue 310 an the manner of a buckle sandwiching a belt. A side-tab 344 at the distal end of the tongue 310 prevents the tongue 310 from being pulled free of the slotted buckle end 314.

The near edge of the tongue 310 as viewed in FIG. 3 (the upper edge as viewed in FIG. 4) is formed with a regularly spaced series of rounded notches 346. In use of the anchorage 300, the slotted buckle end 314 is latched to the tongue 310 by a latch 316 comprising a longitudinally elongated strip-form detent 348 having a regularly spaced series of projections 350 on the edge of the detent 348 adjacent the tongue notches 346. The detent 348 is located adjacent one edge of the slotted buckle end 314 (the near edge as viewed in FIG. 3; the upper edge as viewed in FIG. 4), longitudinally between the slots 340 & 342, and sits in the double-cranked portion of the slotted buckle end 314 (which prevents significant longitudinal displacement of the detent 348 with respect to the slotted buckle end 314). The detent 348 is laterally movable to a limited extent, and is urged laterally against the notched edge of the tongue 310 by suitable spring means (not shown). Interengagement of the detent projections 350 with the tongue notches 346 latches the buckle end 314 to the tongue 310, and so inhibits relative movement of the first and second hooks 302 and 304 upon installation of the anchorage 300 (the function of the latch 316 thereby being analogous to the function of the clamps 116 and 216).

Installation and use of the anchorage 300 is essentially the same as the previously described installation and use of the first and second embodiments 100 and 200 (apart from the use of the latch 316 in place of the clamps 116 and 216). In suitable circumstances (e.g. if the safety net to be anchored by the anchorage 300 had its own ties or attachment hooks) the slings 328 and 334 could be omitted and the safety net directly attached to the hooks 302 and 304, by way of the apertures 326 and/or 332 or in any other suitable manner. The numbers of notches 346 and/or the numbers of projections 350 can be varied from the respective numbers as shown in FIG. 4; in the limiting case, there may be a single projection and/or a single notch (particularly where the anchorage is designed to fit flanges of a uniform width).

The anchorages of the invention can be utilised for attaching articles other than safety nets (e.g. for the anchorage of tethered body harnesses for individual fall prevention).

While certain modifications and variations of the anchorage in accordance with the invention have been described above, the invention is not restricted thereto, and other modifications and variations can be adopted without departing from the scope of the invention as defined in the appended claims.

What is claimed is:

1. An adjustable anchorage comprising:

a safety net;

first and second hook means each capable of being hooked around a respective opposite edge of a bilateral flange, each of the first and second hook means comprising an upper arm, a lower arm and a joining portion between the upper arm and the lower arm;

adjustable linking means extending between the lower arms of said first and second hook means for mutually linking said first and second hook means in use of said anchorage with said first and second hook means respectively hooked round a respective opposite edge of the bilateral flange and for thereupon retaining said first and second hook means against the respective opposite edges of the bilateral flange;

at least one of said first and second hook means being provided with attachment means for attaching said safety net thereto;

said attachment means comprising an aperture in the lower arm of each of the first and second hook means, and a link member attaching the safety net thereto pivoted in said aperture, the link member being free to pivot in said aperture to lie in a direction in which a load applied to the link member pulls the respective hook means inwardly in relation to the respective flange; and said adjustable linking means comprising a strap or web secured at one end thereof to one of said first and second hook means together with clamp means for clamping the strap or web to the other of said first and second hook means at a selected location along the strap or web displaced from said one end of the strap or web.

2. An anchorage as claimed in claim 1, wherein said adjustable linking means has an adjustable length between said first and second hook means.

3. An anchorage as claimed in claim 1, wherein said attachment means comprises a carabiner.

4. An anchorage as claimed in claim 1, wherein said clamp means is self-tightening in response to tension in said web or strap.

5. An anchorage as claimed in claim 4, wherein said clamp means comprises a snail cam.

6. An anchorage as claimed in claim 1, wherein said adjustable linking means incorporates tensioning means capable of applying tension between said first and second hook means whereby to force said first and second hook means against the respective opposite edges of the bilateral flange in use of the anchorage.

7. An anchorage as claimed in claim 4, wherein said tensioning means comprises an overcentre form of said clamp means tending in use to shorten the strap or web between said one end thereof and said selected location thereon.

8. An anchorage as claimed in claim 7, wherein the overcentre clamp means comprises a lever pivotable about an axis, and strap-contacting means on the lever at respective positions radially displaced from said axis such that rotation of said lever with the strap in slack-free contact with said strap-contacting means tightens the strap between said first and second hook means.

9. An anchorage as claimed in claim 8, further comprising lock means for locking said lever when said lever is rotated to tighten said scrap.

10. An anchorage as claimed in claim 9, wherein said lock means also serves as at least one of said attachment means.

11. An anchorage as claimed in claim 2, wherein said adjustable linking means comprises a mutually interpenetrating tongue and slot means together with latch means functioning to latch the tongue and slot means together at a mutual interpenetration which places the first and second hook means at a selected mutual separation.

12. An anchorage as claimed in claim 11, wherein said slot means has the form of a buckle holding said tongue means as a buckle holds a belt.

13. An anchorage as claimed in claim 11, wherein said latch means comprises a detent mounted on said slot means, said detent having at least one projection urged into latching engagement with at least one notch on said tongue means.

14. An anchorage as claimed in claim 11, further comprising stop means preventing detachment of said tongue means from said slot means.

15. An adjustable anchorage according to claim 1, in which said link member is a metal sling.

16. An adjustable anchorage according to claim 1, in which said link member is a carabiner shackle.

* * * * *